US010662683B2

(12) United States Patent
Pettengill et al.

(10) Patent No.: US 10,662,683 B2
(45) Date of Patent: May 26, 2020

(54) LATCH FOR MOTOR VEHICLE WITH PAWL POSITION RETAINING

(71) Applicant: Kiekert AG, Heiligenhaus (DE)

(72) Inventors: Robert S. Pettengill, Farmington, MI (US); Ruben Reyna, Allen Park, MI (US)

(73) Assignee: Kiekert AG, Heiligenhaus (DE)

( * ) Notice: Subject to any disclaimer, the term of this patent is extended or adjusted under 35 U.S.C. 154(b) by 348 days.

(21) Appl. No.: 15/668,082

(22) Filed: Aug. 3, 2017

(65) Prior Publication Data

US 2019/0040661 A1 Feb. 7, 2019

(51) Int. Cl.

| | |
|---|---|
| ***E05B 85/26*** | (2014.01) |
| ***E05C 3/12*** | (2006.01) |
| ***E05B 81/14*** | (2014.01) |
| *E05B 83/36* | (2014.01) |
| *E05B 83/18* | (2014.01) |
| *E05B 85/24* | (2014.01) |

(52) U.S. Cl.

CPC ..... *E05B 85/26* (2013.01); *E05B 81/15* (2013.01); *E05C 3/12* (2013.01); *E05B 83/18* (2013.01); *E05B 83/36* (2013.01); *E05B 85/243* (2013.01)

(58) Field of Classification Search

CPC ..... E05B 85/26; E05B 81/15; E05B 81/14; E05B 83/18; E05B 83/16; E05B 83/36; E05B 85/24; E05B 85/243; E05C 3/12; E05C 19/007

USPC ..... 292/198

See application file for complete search history.

(56) References Cited

U.S. PATENT DOCUMENTS

| | | | | |
|---|---|---|---|---|
| 3,692,343 | A * | 9/1972 | Meyer | E05B 85/243 292/216 |
| 4,875,724 | A * | 10/1989 | Gruber | E05B 83/16 292/216 |
| 6,267,420 | B1 * | 7/2001 | Miyagawa | E05B 83/16 292/216 |
| 6,679,531 | B2 * | 1/2004 | Rogers, Jr. | E05B 83/16 292/216 |
| 2005/0134054 | A1 * | 6/2005 | Stefanic | E05B 17/0004 292/201 |
| 2007/0138802 | A1 * | 6/2007 | Stasko | E05B 81/14 292/201 |
| 2011/0316293 | A1 * | 12/2011 | Luschper | E05B 79/20 292/195 |

* cited by examiner

*Primary Examiner* — Nathan Cumar

(74) *Attorney, Agent, or Firm* — Renner, Otto, Boisselle & Sklar, LLP

(57) ABSTRACT

A motor vehicle latch includes a retaining device which retains the pawl in its starting position with particular reliability during an opening process. The motor vehicle latch includes a locking mechanism encompassing a catch and a pawl for ratcheting of the catch. A retaining device is present which retains the pawl in its non-ratcheting starting position during opening. The retaining device encompasses a spring with an elastically rotated leg and a spring lever mounted thereon which can retain the pawl in its starting position during opening due to the elastic torsion. The pawl is retained in its starting position during opening with the aid of the spring lever and consequently with the aid of a torsional moment.

15 Claims, 2 Drawing Sheets

LATCH FOR MOTOR VEHICLE WITH PAWL POSITION RETAINING

The invention relates to a motor vehicle latch with a locking mechanism. The locking mechanism comprises a catch and at least one pawl.

BACKGROUND

A catch of a motor vehicle latch has a fork-shaped inlet slot into which a locking bolt of a motor vehicle door or motor vehicle flap enters when the motor vehicle door or motor vehicle flap is closed. The locking bolt then rotates the catch from an open position to a closed position. If the catch has reached a closed position, the locking bolt can no longer leave the inlet slot of the catch. In the closed position, a pawl ratchets the catch by moving the pawl from a starting position into its ratchet position. After ratcheting, the catch can no longer be rotated back into the open position.

On a motor vehicle latch, there are regularly two ratchet positions which can be assumed consecutively during closure of the catch, i.e. the so-called pre-ratchet position and the so-called main ratchet position. It is possible that only one pawl is present which is capable of ratcheting the catch in the pre-ratchet position and in the main ratchet position. However, two pawls can also be provided for, whereby the first pawl can ratchet the catch in the pre-ratchet position and the second pawl can ratchet the catch in the main ratchet position.

If the catch is ratcheted by the pawl, the pawl must be moved from its ratchet position into its non-ratcheting starting position in order to open a pertaining door or flap. The catch can subsequently be moved into its open position. If the catch has reached its open position, the locking bolt can leave the catch and the pertaining door or flap can be opened.

In order that the pawl cannot be moved back into its ratchet position in an unscheduled manner during such an opening process, a retaining device can be present which retains the pawl in its starting position during opening. A latch with such a retaining device is known from publication US 2011/316293 A1. The known retaining device comprises an elastically pre-tensioned spring which can retain the pawl in its non-ratcheting starting position during opening due to the elastic pre-tensioning.

SUMMARY OF THE INVENTION

The task of the invention is to create a motor vehicle latch with a retaining device which retains the pawl in its starting position with particular reliability during an opening process.

The task of the invention is solved by the object with the characteristics of the first claim. Advantageous designs result from the dependent claims. Unless stated otherwise hereinafter, the object of the invention can encompass one or several of the aforementioned characteristics.

The task of the invention is solved by a motor vehicle latch with a locking mechanism comprising a catch and a pawl for ratcheting of the catch. A retaining device is present which retains the pawl in its non-ratcheting starting position during opening. For this purpose, the position of the pawl is stored during opening. The retaining device can therefore also be described as a memory device. The retaining device comprises a spring with an elastically rotated leg and a spring lever mounted thereon which can retain the pawl in its starting position during opening due to the elastic torsion.

The pawl is retained in its starting position during opening with the aid of the spring lever and consequently with the aid of a torsional moment.

It has been shown that the pawl can be retained in its starting position during opening in an improved manner and also predominantly in a manner less susceptible to faults compared to the solution known from publication US 2011/316293 A1.

In one design, the elastically rotated leg includes an angle of 70° to 110° with the spring lever, advantageously 80° to 100°. The angle is generally 90° for especially reliable retention.

In one design, the retaining device encompasses a downholder for the elastically rotated spring leg which is arranged adjacent to the spring lever of the retaining device. The downholder holds the elastically rotated spring leg down in such a way that the pawl is thus retained in its starting position during opening in a further improved manner. In particular, the elastically rotated spring leg is also elastically bent and additionally pre-tensioned as a result of the holding down. This additional pre-tensioning contributes in a further improved manner to the pawl being securely retained in its starting position during opening.

In one design of the invention the free end of the elastically rotated spring leg is stepped. The end of the step is connected to an arm of the retaining device, preferably in a form-fitting manner. During opening, the arm of the retaining device is braced on a rib of the catch and thus retains the pawl in its starting position when the locking mechanism is opened.

For form-fitting connection, the stepped end is incorporated in a hook of the arm of the retaining device in one design. For a form-fitting connection, the position of the stepped end and/or the position of the spring lever attached to the elastically rotated leg is ensured by a stop in one design.

The aforementioned arm of the retaining device is connected to the pawl in one design. For example, if the pawl is metallic and also encompasses a plastic sheathing or a plastic coating, in a simple design the arm of the retaining device is integrally connected to the plastic sheathing or the plastic coating. The arm of the retaining device and the pawl can then only be pivoted together.

In one design, the aforementioned arm is part of a latch of the retaining device which is referred to as a retaining device latch hereinafter. This retaining device latch and the pawl are preferably pivotably accommodated coaxially. In one design, the retaining device latch demonstrates a towing arm for the pawl. The towing arm takes the pawl along when the retaining device latch is pivoted away from the catch. The pawl is then pivoted in the direction of the starting position. Otherwise, the pawl can also be moved from its ratchet position into its starting position independently of the retaining device latch. The retaining device latch can be pivoted back in the direction of the catch without the pawl absolutely needing to follow this movement due to the towing arm. The pawl can be moved from its starting position in the direction of its ratchet position independently of the retaining device latch when the retaining device latch is already pivoted in the direction of the catch. Otherwise, the retaining device latch and the pawl can also be pivoted together in the direction of the catch. This design permits a great diversity of constructional options.

In one design, the retaining device latch can be firmly connected to the pawl.

In one design of the invention, the retaining device encompasses one or several retaining elements for the spring in the region of the axis in order to thus be able to retain the spring in a technically simple manner, by form fitting in principle.

In one design, there is a guide for the arm of the retaining device which ensures the position of the arm of the retaining device relative to the catch if the catch is pivoted from its open position into its closed position. In a technically simple design, the rib connected to the catch acts as a guide. If the catch is pivoted from its open position in the direction of the closed position, in one design an end of the rib merges into a bridge-like indentation of the arm of the retaining device. The arm of the retaining device is subsequently guided by the rib and the position of the arm of the retaining device is thus ensured relative to the catch. The arm of the retaining device is then accommodated in such a way that the pawl can ratchet the catch when the catch reaches its closed position.

The end of the rib which can merge into the bridge-like indentation of the arm of the retaining device is preferably formed in a pointed manner to facilitate merging.

The bridge-like indentation preferably demonstrates a ramped lateral wall which enables the arm of the retaining device comprising at least elastic material to slide beyond the rib if the arm of the retaining device is pivoted in the direction of the starting position of the pawl for opening. Alternatively or additionally, the relevant lateral wall of the rib can be ramped.

In one design, the bridge-like indentation demonstrates a vertical wall or at least a predominantly vertical lateral wall. This vertical lateral wall is located on a vertical lateral wall or at least a predominantly vertical lateral wall of the rib if the arm of the retaining device is guided by the rib during closure. Both vertical walls ensure that the arm of the retaining device cannot be pivoted further in the direction of the catch in an unscheduled manner.

The rib is in particular arch-shaped in order to suitably guide.

In one design of the invention, the spring is pre-tensioned with the elastically rotated leg in such a way that this spring can pivot the arm of the retaining device in the direction of the catch due to pre-tensioning. A further pre-tensioned spring can exist for the pawl which can move the pawl in the direction of the ratchet position due to the pre-tensioning. A further spring for the pawl is provided for in particular if the arm of the retaining device is not directly or indirectly firmly connected to the pawl.

The invention is explained in further detail hereafter with the aid of figures on the basis of a single design example. The invention is not restricted to the design example. Deviations are therefore possible.

BRIEF DESCRIPTION OF THE DRAWINGS

The following are shown.

DETAILED DESCRIPTION

Figure 1:
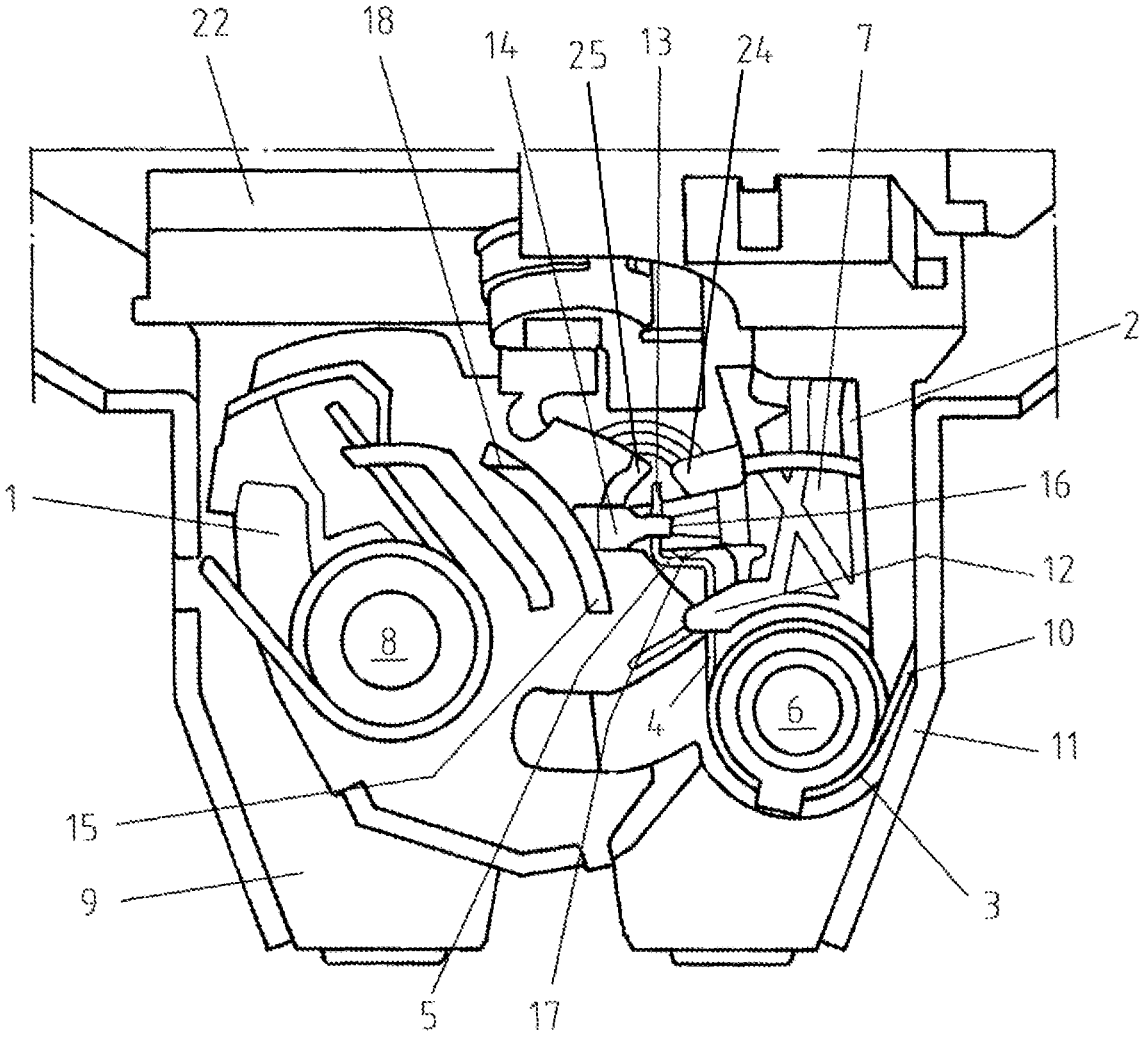
FIG. 1: Internal view of the motor vehicle latch.

FIG. 1 shows sections of a motor vehicle latch during opening with a locking mechanism which encompasses a catch 1 and a pawl 2 for ratcheting of the catch 1. The catch 1 is still in its closed position. The pawl 2 has already been moved out of its ratchet position and is in its starting position. For opening, the catch 1 will rotate clockwise in the direction of the open position. During this torsional movement, a retaining device explained hereinafter will ensure that the pawl 2 cannot be pivoted in a counter-clockwise direction in the direction of the ratchet position. If the catch has reached its open position, the retaining of the pawl 2 by the retaining device becomes redundant. It is therefore subsequently possible for the pawl 2 to ratchet the catch as soon as the catch 1 has reached its closed position within the context of a closure process.

The retaining device encompasses a leg spring 3 with an elastically rotated leg 4 and a mounted spring lever 5. The elastically rotated leg 4 includes a 90° angle with the spring lever 5.

The leg spring 3 includes an axis 6 by means of which the pawl 2 and a latch 7 of the retaining device can be pivotably accommodated together. The retaining device latch 7 has been pivoted for opening like the pawl 2 in the direction of the starting position, namely in a clockwise direction around the axis 6. The retaining device latch 7 made of plastic can be firmly connected to the pawl 2 in such a way that the retaining device latch 7 and the pawl 2 can only ever be pivoted together. Alternatively, the retaining device latch 7 can encompass a towing arm for the pawl 2 which can take along the pawl in the direction of the starting position if the retaining device latch 7 is pivoted away from the catch 1 in the direction of the starting position.

The catch 1 is pivotably accommodated by an axis 8. Both axes 6 and 8 of the catch 1 and pawl 2 are attached to a latch plate 9 made of metal. The non-rotated leg 10 of the leg spring 3 is braced on a lateral wall 11 of a plastic latch housing. The spring 3 is thus pre-tensioned in such a way that the spring 3 can pivot the retaining device latch 7 in the direction of the catch 1 due to this pre-tensioning which is prevented, however, in the case shown in FIG. 1 and consequently during opening by the retaining device. As a consequence hereof, the pawl 2 in the case of FIG. 1 and therefore during opening can also not be pivoted around the axis 6 in the direction of the catch for ratcheting in a counter-clockwise direction.

The retaining device encompasses a downholder 12 for the elastically rotated spring leg 4. The downholder 12 is arranged adjacent to the spring lever 5 of the retaining device. The downholder 12 holds the elastically rotated spring leg 4 down in the direction of the latch plate 9 down in such a way that the pawl 2 is thus retained in its starting position during opening in a further improved manner. The downholder 12 therefore presses the elastically rotated spring leg 4 in the direction of the latch plate 9. The elastically rotated spring leg 4 is elastically bent or distorted by the holding down and is thus also pre-tensioned. This additional pre-tensioning contributes in a further improved manner to the pawl 2 being securely retained in its starting position during opening as shown in FIG. 1.

The free end of the elastically rotated spring leg 4 is executed in a stepped shape. The spring lever 5 is part of this stepped shape as shown in FIG. 1. The end 13 of the stepped shape is connected in a form-fitting manner to an arm 14 protruding laterally from the retaining device latch 7.

During opening, the arm 14 of the retaining device is laterally braced to the arch-shaped rib 15 of the catch 1 and thus retains the retaining device latch 7 in its starting position shown together with the pawl 2. The arm 14 of the retaining device is pressed in the direction of the latch plate by the spring 3 in order to ensure that the arm 14 consisting of an elastic plastic material does not slide over the rib 15 in the direction of the catch in an unscheduled manner. This force exerted in the direction of the latch plate results both from the elastic torsion of the leg 4, whereby the spring lever 5 exerts a pressure or a force on the arm 14 over the stepped end 13 in the direction of the latch plate 9. This force exerted in the direction of the latch plate results both from the elastic distortion of the leg 4 of the spring 3 generated by the downholder 12. Furthermore, the spring 3 is also pre-tensioned in such a way that the arm 14 is pressed in the direction of the catch. The spring 3 is therefore pre-tensioned threefold to thus contribute to proper functioning.

For form-fitting connection, the stepped end 13 is incorporated in a hook 16 of the arm 14 of the retaining device. The position of the spring lever 5 is ensured by a stop 17 for a secure, form-fitting connection. The stop 17 protrudes laterally from the arm 14 of the retaining device and is integrally connected to it.

During a closure process, the rib 15 acts as a guide for the arm 14 of the retaining device. The position of the arm 14 of the retaining device is secured relatively to the catch 1 due to the guide if the catch 1 is pivoted from its open position into its closed position shown in FIG. 1. If the catch 1 is pivoted around the axis 8 in a counter-clockwise direction from its open position in the direction of the closed position, the sharp end 18 of the rib 15 merges into the bridge-like indentation 19 of the arm 14 of the retaining device shown in FIG. 2. The arm 14 of the retaining device is subsequently guided by the rib 15 and the position of the arm 14 of the retaining device is thus secured relative to the catch. The arm 14 of the retaining device is then accommodated in such a way that the pawl 2 can ratchet the catch 1 when the catch 1 reaches its closed position.

Figure 3:
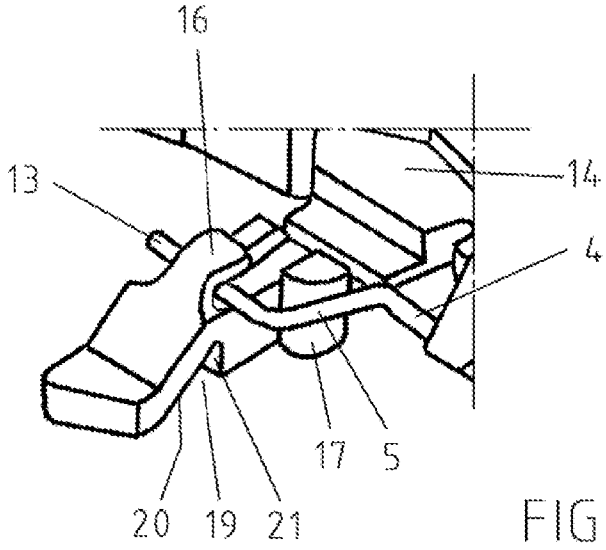
FIG. 3: Retaining device latch arm

The bridge-like indentation 19 preferably demonstrates a ramped lateral wall 20 as shown in FIG. 3 which enables the arm 14 of the retaining device comprising elastic material to slide beyond the rib 15 if the arm 14 of the retaining device is pivoted in the direction of the starting position of the pawl 1 for opening. Pivoting takes place with the aid of an activation device which can encompass a motor for opening in order to thus facilitate opening.

The bridge-like indentation 19 opposite demonstrates a vertical lateral wall 21. This vertical lateral wall 21 is located on a vertical lateral wall of the rib 15 if the arm 14 of the retaining device is guided by the rib 15 during closure. Both vertical walls ensure that the arm 14 of the retaining device cannot be pivoted in the direction of the catch 1 in an unscheduled manner during a closure process.

Figure 2:
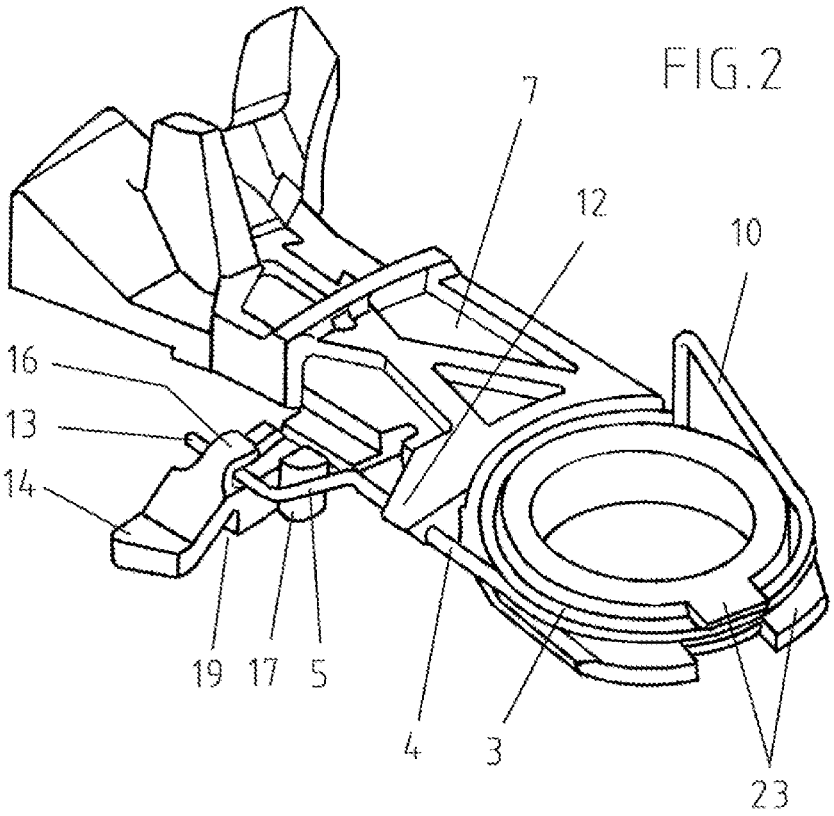
FIG. 2: Retaining device latch

The latch shown in FIG. 1 encompasses a mechanism 22, with which the retaining device latch 7 can be moved out of the ratchet position together with the pawl 2 for opening. Retaining media 23 of the retaining device latch 7 for the spring 3 are shown in FIG. 2. These contribute to a form-fitting retention of the spring 3. The rib 15 on the catch 1 can be part of a plastic sheathing. The catch 1 is otherwise made of metal in principle. The ratchet shoulder 24 of the pawl shown in FIG. 1 is moved in the direction of the catch for ratcheting until the ratchet shoulder 24 blocks a movement of the ratchet shoulder 25 of the catch in such a way that the catch 1 cannot be pivoted clockwise in the direction of the open position.

REFERENCE SIGN LIST

1: Catch
2: Pawl
3: Leg spring
4: Elastically rotated leg of the leg spring
5: Spring lever
6: Axis for the pawl
7: Retaining device latch
8: Axis for the catch
9: Latch plate
10: Spring leg
11: Lateral wall
12: Downholder
13: Spring leg end
14: Arm of the retaining device
15: Rib on the catch
16: Hook
17: Stop
18: Sharp end of the rib
19: Bridge-shaped indentation
20: Ramped lateral wall of the indentation
21 Vertical lateral wall of the indentation
22: Mechanism for triggering the locking mechanism
23: Retaining elements for the spring
24: Ratchet shoulder of the pawl
25: Ratchet shoulder of the catch

The invention claimed is:

1. A motor vehicle latch with a locking mechanism, comprising:

a pivotably accommodated catch and a pivotably accommodated pawl for ratcheting of the catch, a retaining device for retaining the pawl in a non-ratcheting starting position during opening of the motor vehicle latch, wherein the retaining device includes a spring having an elastically rotated spring leg with a spring lever mounted thereon for retaining the pawl in the non-ratcheting starting position during opening due to elastic torsion, and wherein the retaining device includes a downholder that presses the elastically rotated spring leg to elastically bend the elastically rotated spring leg whereby the elastically rotated spring leg is pre-tensioned by the downholder in the non-ratcheting starting position during opening.

2. The motor vehicle latch of claim 1, wherein the elastically rotated spring leg includes an angle with the spring lever of 70° to 110°.

3. The motor vehicle latch of claim 1, wherein the retaining device includes an arm braced on a rib connected to the catch during opening, whereby the pawl is retained in the non-ratcheting starting position during opening.

4. The motor vehicle latch of claim 3, wherein a free end of the elastically rotated spring leg is connected by a form-fitting manner to the arm of the retaining device.

5. The motor vehicle latch of claim 4, wherein the free end of the elastically rotated spring leg is stepped.

6. The motor vehicle latch of claim 4, wherein the arm of the retaining device includes a hook for form-fitting connection into which the free end of the elastically rotated spring leg is incorporated.

7. The motor vehicle latch of claim 1, wherein a position of the spring lever is ensured by a stop.

8. The motor vehicle latch of claim 4, wherein the arm of the retaining device is part of a retaining device latch, whereby the retaining device latch and the pawl are pivotably accommodated by a common axis.

9. The motor vehicle latch of claim 8, wherein the retaining device latch is configured to take along the pawl during pivoting away of the retaining device latch from the pawl.

10. The motor vehicle latch of claim 3 further comprising a guide for the arm of the retaining device for ensuring a position of the arm of the retaining device relative to the catch during pivoting of the catch from an open position to a ratchet position.

11. The motor vehicle latch of claim 10, wherein the rib is part of the guide.

12. The motor vehicle latch of claim 11, wherein the arm of the retaining device has a bridge-shaped indentation into which the rib merges when the catch is pivoted from the open position in a direction of the ratchet position.

13. The motor vehicle latch of claim 12, wherein the rib and/or the bridge-shaped indentation includes a lateral, ramped wall which enables the bridge-shaped indentation to slide over the rib when the arm of the retaining device is pivoted in the direction of the non-ratcheting starting position of the pawl for opening.

14. The motor vehicle latch of claim 5, wherein the arm of the retaining device encompasses a hook for form-fitting connection into which the free end of the elastically rotated spring leg is incorporated.

15. The motor vehicle latch of claim 8, wherein the retaining device latch is firmly connected to the pawl.

* * * * *